US007843299B2

(12) United States Patent
Dinnan et al.

(10) Patent No.: US 7,843,299 B2
(45) Date of Patent: Nov. 30, 2010

(54) INDUCTIVE DEVICES AND TRANSFORMERS UTILIZING THE TRU-SCALE REACTANCE TRANSFORMATION SYSTEM FOR IMPROVED POWER SYSTEMS

(75) Inventors: James A. Dinnan, Athens, GA (US); Patrick Hernandez, Sacramento, CA (US); Joseph A. Dinnan, Folsom, CA (US)

(73) Assignee: Meta-C Corporation, Athens, GA (US)

( * ) Notice: Subject to any disclaimer, the term of this patent is extended or adjusted under 35 U.S.C. 154(b) by 980 days.

(21) Appl. No.: 11/259,457

(22) Filed: Oct. 25, 2005

(65) Prior Publication Data

US 2007/0090909 A1 Apr. 26, 2007

(51) Int. Cl.
*H01F 27/28* (2006.01)

(52) U.S. Cl. ..... 336/182

(58) Field of Classification Search ..... 336/65, 336/83, 180–186, 200
See application file for complete search history.

(56) References Cited

U.S. PATENT DOCUMENTS

| | | | | |
|---|---|---|---|---|
| 3,059,143 | A | 10/1962 | Sola | |
| 4,860,624 | A | 8/1989 | Dinnan et al. | |
| 5,306,865 | A | 4/1994 | Dinnan et al. | |
| 6,003,000 | A | 12/1999 | Ozzimo et al. | |
| 6,178,316 | B1 | 1/2001 | Dinnan et al. | |
| 6,191,495 | B1 * | 2/2001 | Kossives et al. | 257/798 |
| 6,415,253 | B1 | 7/2002 | Johnson | |
| 6,879,224 | B2 | 4/2005 | Frank | |
| 6,879,237 | B1 | 4/2005 | Viarouge et al. | |
| 2003/0038696 | A1 | 2/2003 | Chui | |
| 2003/0198062 | A1 * | 10/2003 | Yasumura | 363/16 |
| 2006/0071626 | A1 | 4/2006 | Dinnan et al. | |

OTHER PUBLICATIONS

Yahoo! Encyclopedia: Induction, in electricity and magnetism.
Handbook of Transformer Design and Applications, by William M. Flannagan (1993), Introduction, p. 1.1.
The Inventions, Researches and Writings of Nikola Tesla, published by Barnes & Noble Inc., 1995, p. 343.
Britannica Online, "transformer"; http://www.britannica.com/ebc/article-9381073?query=transformer&ct=.
Transformer and Inductor Design Handbook, Third Edition, Revised and Expanded, Col. Wm. T. McLyman, 2004, pp. 6-3.

* cited by examiner

*Primary Examiner*—Tuyen Nguyen
(74) *Attorney, Agent, or Firm*—Kenyon & Kenyon LLP

(57) ABSTRACT

In inductive devices and transformers, a periodic transformation system reduces or prevents heat or distortion, reduces resistance or impedance and improves output energy. In one embodiment, the Tru-Scale Reactance Transformation System provides an harmonic relationship among the core, winding, magnetic flux, and the current in order to maximize energy output of inductive devices, such as a transformer, by reducing EMF collisions in any type of power systems.

10 Claims, 1 Drawing Sheet

Standard Wave=0: Pi (3.1416)/50:10=Pi Plot 3
(sin, cos, wave−wave)

Tru−Scale Wave=0: 3/50: 10=3 Wave Contrast=0: 3.125/50=3.125"C"−
Plot 3 (sin(wave), cos (wave contrast), wave−wave contrast)

INDUCTIVE DEVICES AND TRANSFORMERS UTILIZING THE TRU-SCALE REACTANCE TRANSFORMATION SYSTEM FOR IMPROVED POWER SYSTEMS

FIELD OF THE INVENTION

The present invention relates to an improvement in inductive device/transformer efficiency between input power and output power, by focusing on the ratio of harmonic associations of the magnetic fields created by the mass, the power train (coil or coils) and the input-output voltage currents. More particularly, the invention relates to the use of a periodic transformation system known as the Tru-Scale Reactance Transformation System to reduce electomotive force (EMF) collisions in any type of power system, through a series of mathematical transformations.

BACKGROUND OF THE INVENTION

Yahoo Encyclopedia, 2003, defines electro magnetic induction as the production of EMF in a conductor as a result of a changing magnetic field around the conductor.

According to the *Handbook of Transformer Design and Applications*, by William M. Flanagan (1993), "Transformers are passive devices for transforming voltage and current."

U.S. Pat. No. 6,879,224B2 teaches that "Inductors (L) and capacitors (C) are universally used in electronics for numerous functions. One function is to provide low loss impedance transformation." The patent states further, "The impedance of each section is a function of the inductance and the capacitance. Specifically $$Z = \sqrt{\frac{L}{C}}.$$

At the frequency of resonance, the resonator is a short circuit. The resonator frequency is a function of L and C."

Nikola Tesla stated:

"The magnitude of the resonance effect depends, under otherwise equal conditions, on the quantity of electricity set in motion or on the strength of the current driven through the circuit. But the circuit opposes the passage of the current by reason of its impedance and therefore, to secure the best action it is necessary to reduce the impedance to a minimum . . . . But when the frequency of the impulses is great, the flow of the current is practically determined by self-induction. Now self-induction can be overcome by combining it with capacity. If the relation between these is such, that at the frequency used they annul each other, that is, have such values as to satisfy the condition of resonance, and the greatest quantity of electricity is made to flow through the external circuit, then the best result is obtained."

Britannica Online defines a transformer as a "device that transfers electric energy from one alternating-current circuit to one or more other circuits, either increasing (stepping up) or reducing (stepping down) the voltage."

U.S. Pat. No. 6,879,237 teaches, "When saturation occurs, the magnetizing current can increase in great proportions and produce an excessive heating of the windings. 'Further' in these structures, there are also important magnetic stray fields and leakage flux which circulate in the external environment of the device and can induce parasitic perturbations in electrical or electronic circuits . . . ."

Colonel William T. McLyman in his book Transformer and Inductor Design Handbook relates the following: "Transformer efficiency, regulation, and temperature rise are all interrelated. Not all of the input power to the transformer is delivered to the load. The difference between input power and output power is converted into heat. This power loss can be broken down into two components: core loss, $P_{ce}$ and copper loss, $P_{cu}$. The core loss is a fixed loss, and the copper loss is a variable loss that is related to the current demand of the load. The copper loss increases by the square of the current and also is termed a quadratic loss. Maximum efficiency is achieved when the fixed loss is equal to the quadratic loss at rated load. Transformer regulation, a, is the copper loss, $P_{cu}$ divided by the output power, $P_o$.

$$a = \frac{P_{cu}}{P_o}(100)[\%]$$

The efficiency of a transformer is a good way to measure the effectiveness of the design. Efficiency is defined as the ratio of the output power, $P_o$ to the input power, $P_{IN}$. The difference between, $P_o$ and, $P_{IN}$ is due to losses. The total power loss, $P_\Sigma$, in the transformer is determined by the fixed losses in the core and the quadratic losses in the windings or copper. Thus, $$P_\Sigma = P_{fe} + P_{cu}^2 [\text{watts}]$$

Where $P_{fe}$ is the core loss, and $P_{cu}$ is the copper loss. Maximum efficiency is achieved when the fixed loss is made equal to the quadratic loss.

In the magnetic circuit, the non-harmonic relationship of the core's internal and external dimensions and/or material causes magnetic impedance of the wave (sine, square, sawtooth, etc.) because of the wave being cut off and/or deflected at a partial of itself or harmonic within the magnetic material and/or air space. In order to have the most efficient transformer design, all components must have an harmonic relationship to each other as well as the electrical characteristics of the system with which the transformer operates.

U.S. patent application Ser. No. 10/959,457 teaches according to investigations that the inventors have undertaken, that while it appears that attempts have been made to use resonance characteristics advantageously in areas such as radio modulation and audio, in power systems precisely the opposite approach has been taken, as witnessed by the numerous attempts to reduce or eliminate resonance. From what the inventors have been able to determine, the transient nature of resonance has led to the perception that resonance is undesirable in power generation and transmission systems. Resonance has led to power spikes, which can be damaging to electrical equipment.

Because there are efficiencies to be obtained from the power levels resulting from resonance, it would be desirable to determine how to make resonance a persistent, rather than a transient phenomenon.

Another well known factor is the use of hazardous materials (oil for example) as a means of dissipating heat both in overhead and underground facilities using transformers. It is possible to reduce this use of hazardous materials through substantial reduction of the heat factor.

SUMMARY OF THE INVENTION

In view of the foregoing, it is one object of the present invention to provide a transformer design that takes advantage of an harmonic relationship between and among the inductive devices and transformers using Tru-Scale ratios, particularly using the Tru-Scale Reactance Transformation System.

The novel Tru-Scale Reactance Transformation System reduces the harmonic relations between and among the known causes of losses. No such correction factor as this exists in the current state of the art of electricity production.

Modern power transformer design only considers the maximum energy transfer (power as in watts and/or volt-amperes) when selecting the core type, shape and material without primary consideration of the effects of the core on the harmonic relationships of the signal passed through it. It is generally understood that different types and shapes of cores perform better in different situations, but there is little or no understanding of why this occurs. A great deal of research has been performed on core and coil design but there is a disconnect between the theoretical research and the practical applications. When transformers and inductors are designed, a core is selected from a list of approved cores for a given volt-ampere relationship. The gage of wire is selected, for good reason, to accommodate the amperage at a given maximum voltage in the relative parts of the circuit. Once the wire gage is selected, the number of turns in the windings is determined by the wire's ability to fit in the selected core's bobbin area. The resulting transformer becomes a compromise to fit off-the-shelf components as independent of each other.

In an idealized transformer and inductor, specific Tru-Scale ratios, found in accordance with a series in a Tru-Scale Reactance Transformation System as disclosed herein, need to be considered when sizing and selecting core materials. The individual laminate sections of the core should have an harmonic relationship with the frequency of the signal passed through it. The number of laminations needs to be harmonically related to the frequency and number of turns selected for the windings.

The following table provides a set of inductive reactance and capacitive reactance values, and intervals according to one embodiment of the Tru-Scale Reactance Transformation System. It should be noted that this table reflects only a limited number of intervals in this embodiment of the Tru-Scale Reactance Transformation System. The table can be extrapolated upwardly and downwardly to yield additional values.

TRU-SCALE REACTANCE TRANSFORMATION SYSTEM TABLE 1

| Capacitive Reactance | Ratio | Interval | Ratio | Inductive Reactance | Interval |
|---|---|---|---|---|---|
| 150 | 25:25 | | 24:24 | 150 | |
| 156 | 26:25 | 6 | 25:24 | 156.25 | 6.25 |
| 162 | 27:25 | 6 | 26:24 | 162.5 | 6.25 |
| 168 | 28:25 | 6 | 27:24 | 168.75 | 6.25 |
| 174 | 29:25 | 6 | 28:24 | 175 | 6.25 |
| 180 | 30:25 | 6 | 29:24 | 181.25 | 6.25 |
| 186 | 31:25 | 6 | 30:24 | 187.5 | 6.25 |
| 192 | 32:25 | 6 | 31:24 | 193.75 | 6.25 |
| 198 | 33:25 | 6 | 32:24 | 200 | 6.25 |
| 204 | 34:25 | 6 | 33:24 | 206.25 | 6.25 |

-continued

TRU-SCALE REACTANCE TRANSFORMATION SYSTEM TABLE 1

| Capacitive Reactance | Ratio | Interval | Ratio | Inductive Reactance | Interval |
|---|---|---|---|---|---|
| 210 | 35:25 | 6 | 34:24 | 212.5 | 6.25 |
| 216 | 36:25 | 6 | 35:24 | 218.75 | 6.25 |
| 222 | 37:25 | 6 | 36:24 | 225 | 6.250 |
| 228 | 38:25 | 6 | 36:24 | 225 | 6.25 |
| 234 | 39:25 | 6 | 37:24 | 231.25 | 6.25 |
| 240 | 40:25 | 6 | 38:24 | 237.5 | 6.25 |
| 246 | 41:25 | 6 | 39:24 | 243.75 | 6.25 |
| 252 | 42:25 | 6 | 40:24 | 250 | 6.25 |
| 258 | 43:25 | 6 | 41:24 | 256.25 | 6.25 |
| 264 | 44:25 | 6 | 42:24 | 262.5 | 6.25 |
| 270 | 45:25 | 6 | 43:24 | 268.75 | 6.25 |
| 276 | 46:25 | 6 | 44:24 | 275 | 6.25 |
| 282 | 47:25 | 6 | 45:24 | 281.5 | 6.25 |
| 288 | 48:25 | 6 | 46:24 | 287.5 | 6.25 |
| 294 | 49:25 | 6 | 47:24 | 293.75 | 6.25 |
| 300 | 50:25 | 6 | 48:24 | 300 | 6.25 |

In an ideal situation, the gage of wire should fit in with these relationships precisely, when considering the voltage and amperage in the circuit. The number of turns for the windings need to have an harmonic relationship to the system frequency, core size, core shape, circuit voltage, and circuit amperage. The turns ratio between the primary and secondary (and tertiary and quaternary, etc. if present) should use Tru-Scale ratios. Thus, all components of the system need to be aligned and selected harmonically to each other for an idealized system.

The following table provides another set of inductive reactance and capacitive reactance values, and intervals which includes one embodiment of the Tru-Scale Reactance Transformation System. It should be noted that this table reflects only a limited number of intervals in this embodiment of Tru-Scale. The table can be extrapolated upwardly and downwardly to yield additional values.

TRU-SCALE REACTANCE TRANSFORMATION SYSTEM TABLE 2

| Capacitive Reactance | Ratio | Interval | Ratio | Inductive Reactance | Interval |
|---|---|---|---|---|---|
| 600 | 25:25 | | 24:24 | 600 | |
| 624 | 26:25 | 24 | 25:24 | 625 | 25 |
| 648 | 27:25 | 24 | 26:24 | 650 | 25 |
| 672 | 28:25 | 24 | 27:24 | 675 | 25 |
| 696 | 29:25 | 24 | 28:24 | 700 | 25 |
| 720 | 30:25 | 24 | 29:24 | 725 | 25 |
| 744 | 31:25 | 24 | 30:24 | 750 | 25 |
| 768 | 32:25 | 24 | 31:24 | 775 | 25 |
| 792 | 33:25 | 24 | 32:24 | 800 | 25 |
| 816 | 34:25 | 24 | 33:24 | 825 | 25 |
| 840 | 35:25 | 24 | 34:24 | 850 | 25 |
| 864 | 36:25 | 24 | 35:24 | 875 | 25 |
| 888 | 37:25 | 24 | 36:24 | 900 | 250 |
| 912 | 38:25 | 24 | 36:24 | 900 | 25 |
| 936 | 39:25 | 24 | 37:24 | 925 | 25 |
| 960 | 40:25 | 24 | 38:24 | 950 | 25 |
| 984 | 41:25 | 24 | 39:24 | 975 | 25 |
| 1008 | 42:25 | 24 | 40:24 | 1000 | 25 |
| 1032 | 43:25 | 24 | 41:24 | 1025 | 25 |
| 1056 | 44:25 | 24 | 42:24 | 1050 | 25 |
| 1080 | 45:25 | 24 | 43:24 | 1075 | 25 |
| 1104 | 46:25 | 24 | 44:24 | 1100 | 25 |
| 1128 | 47:25 | 24 | 45:24 | 1125 | 25 |
| 1152 | 48:25 | 24 | 46:24 | 1150 | 25 |

-continued

TRU-SCALE REACTANCE TRANSFORMATION SYSTEM TABLE 2

| Capacitive Reactance | Ratio | Interval | Ratio | Inductive Reactance | Interval |
|---|---|---|---|---|---|
| 1176 | 49:25 | 24 | 47:24 | 1175 | 25 |
| 1200 | 50:25 | 24 | 48:24 | 1200 | 25 |

In an air core inductor and/or transformer, a special condition of series resonance takes on the same characteristics as a ferrite core transformer without the loss and resistive effects of the ferrite core. This type of inductor or transformer also has a self protection in that it will only allow a certain maximum amount of energy across the windings depending on the configuration. When the maximum is exceeded, no more energy is transferred and no excess heat is generated. The output of the circuit, in the case of a transformer, falls rapidly to zero. In contrast, in a ferrite core transformer and inductor, if the maximum energy capabilities of the core are exceeded, the core's temperature rises at an equally rapid rate, causing damage to the circuit. The present invention solves the heat damage problem in the following manner, according to one embodiment.

To balance and maintain proper signal alignment within the transformer, in one embodiment a tertiary or extra winding which matches the primary winding needs to be added. This tertiary or extra winding can be wound at the same time as the primary, or can be added as a separate layer of windings. The number of turns for the extra winding should match the primary winding or have an harmonic relationship with the primary. A parallel resonant state needs to be established with this tertiary or extra winding. That parallel resonant state has the effect of realigning the signal in the core for optimum transfer from the primary windings to the other windings. With this resonant state, the transformer loss is minimized, and the heating factor thereby minimized as well.

Resonance is widely misunderstood. There are several slightly differing views across all the different scientific disciplines as to what resonance represents and means to a circuit. In radio theory, resonance is accepted as special frequency and phase relationships which create a self reinforcing "boosting" effect on the signal which closes the gap of peak to RMS (Root Mean Square) power of the signal. In one aspect of audio theory, resonance is a special relationship between frequency and the characteristics of matter in an object which creates a "bootstrapping" amplification effect which causes a catastrophic destructive effect on the material. In energy theory, resonance is accepted as the alignment of the phases between the voltage and amperage of a circuit which creates an idealized energy state. This state is determined by the calculation of the power factor of the running circuit.

The present invention, described herein in accordance with one embodiment, builds on the Tru-Scale Octave Transformation System, as described variously in U.S. Pat. Nos. 4,860,624, 5,306,865, 6,003,000, 6,178,316, and 6,415,253, the disclosures of which are incorporated by reference herein.

BRIEF DESCRIPTION OF THE DRAWINGS

The invention now will be described in detail with reference to embodiments thereof, along with the accompanying drawings, in which FIG. 1(*a*) shows an output according to the standard method, and FIG. 1(*b*) shows an output according to the Tru-Scale Reactance Transformation System.

DETAILED DESCRIPTION OF EMBODIMENTS

Figure 1A:
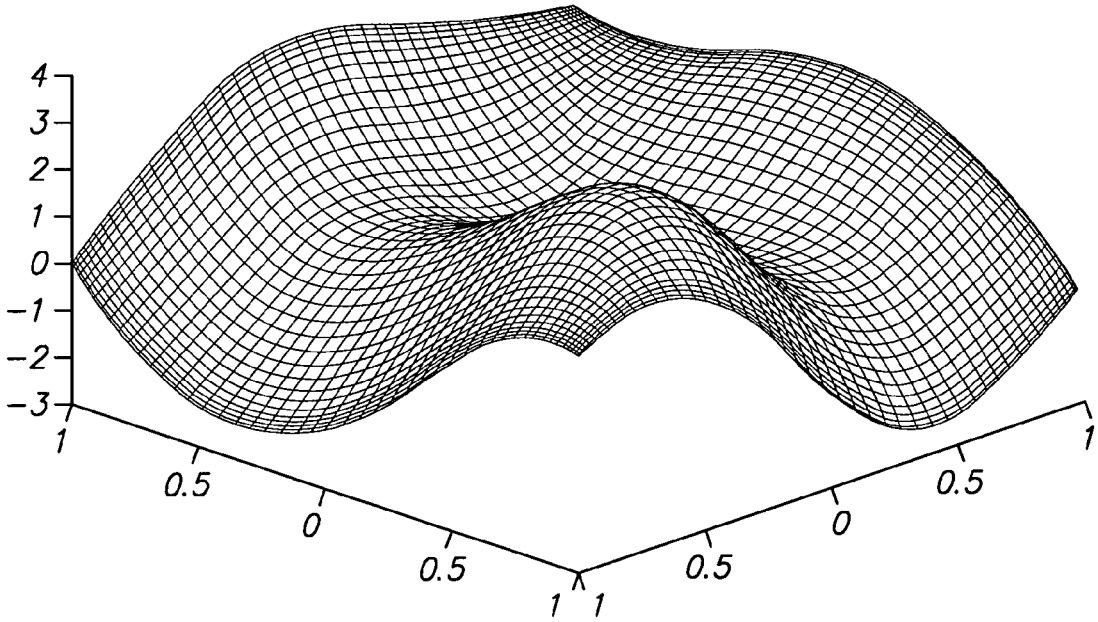

In the course of their research, the inventors have analyzed the relationships between inductive reactance and capacitive reactance and the harmonic balance of magnetic properties of the entire component parts of inductive devices and specifically a transformer. The following steps are necessary to provide such relationships in accordance with the Tru-Scale Reactance Transformation System.

Step 1 The Core

Dimensions. (geometry) All dimensions have an harmonic ratio to each other and to the frequency of the system according to the Tru-Scale matrix.

Step 2 The Laminations

The thickness of the laminations are an harmonic of the frequency of the system. The number of laminations in the core is an harmonic of the frequency of the system.

Step 3 The Material

Core material has an alloy ratio according to the Tru-Scale matrix. Example—percent of silica to iron, percent of nickel to iron, and/or percent of cobalt to iron.

Step 4 the Magnetic Properties of the Core (a) Tru-Scale Method: the peak to peak power of the transformer is calculated, the peak flux density is calculated for the transformer at the calculated power level, and the core is selected with a flux density at ½ the maximum residual flux density at the calculated power level.

(b) In contrast, in the Standard Method: the total average power of the transformer is estimated, and the estimated total flux density is calculated for that power and compared to core properties at saturation flux density for the material selected at a 50 degree Celsius temperature rise in the core.

Step 5 The Bobbin (a) Tru-Scale Method: each winding has its own sector on the bobbin and is isolated from the other. An extra winding and sector are added for the tuning of the magnetic circuit.

(b) In contrast, in the Standard Method: one sector is used for all windings. Two or more sectors will sometimes be used for a split winding and/or a multiple output transformer such as:

Split winding transformer—put one half of one of the windings on each side of another winding.

Multiple output transformer—A multiple output transformer typically is for several different voltages available from the same transformer instead of tapping several locations on one winding.

Step 6 The Windings (a) Tru-Scale Method: the primary winding with a number of turns according to the Tru-Scale matrix is used and the gage is selected to approximately 161 amperes per square centimeter. The number of turns selected is ideally an harmonic of the system frequency and the flux density is at ½ the maximum residual flux density at maximum load.

The next windings (secondary, tertiary, etc.) are designed to the desired output voltage for each with the number of turns selected from the Tru-Scale matrix. The gage is selected to match the primary winding's current density at maximum load.

Tuning is accomplished by selecting the additional winding's number of turns from the Tru-Scale matrix and selecting the gage to have the winding's current density match the primary winding.

(b) In contrast, in the Standard Method: use the number of turns and gage of wire for each winding as estimated from the operating current density at maximum load and/or the desired estimated winding inductance and core operating at the saturation flux density at full load with the winding window is filled to as close to 100 percent as possible.

In summary, the present invention using an harmonic Tru-Scale Reactance Transformation System in a Tru-Scale transformer has all the parts of the transformer designed, evaluated and treated as directly related to each other. Each component has an harmonic relationship with the other components, including the electrical system parameters such as the frequency of the system. In contrast, a standard transformer has each individual part of the transformer designed, evaluated and treated as a separate entity, thereby yielding only indirect relationships with the other parts. For example, the magnetic components are designed separately from the electrical components and the parts are put together and evaluated. Sometimes a more efficient design is discovered, but it is only through trial and error, with no consistent method of repeating efficient designs, and lacking any harmonic relationships.

However, the benefits of the Tru-Scale Reactance Transformation System can be realized by adding an additional winding and establishing a resonant state with the magnetic and/or electrical and/or inductive properties of the transformer, using a capacitor or other reactive component of appropriate size according to the Tru-Scale matrix. In this manner, the impedance because of transfer of energy from one state to the other (i.e., electrical to magnetic), as well as other causes, can be minimized. By keeping the additional winding electrically isolated but magnetically coupled to the circuit, the negative effects of an additional winding in a circuit (as in a filter) will not be realized, but the benefits of reduced impedance will be realized.

Figure 1B:
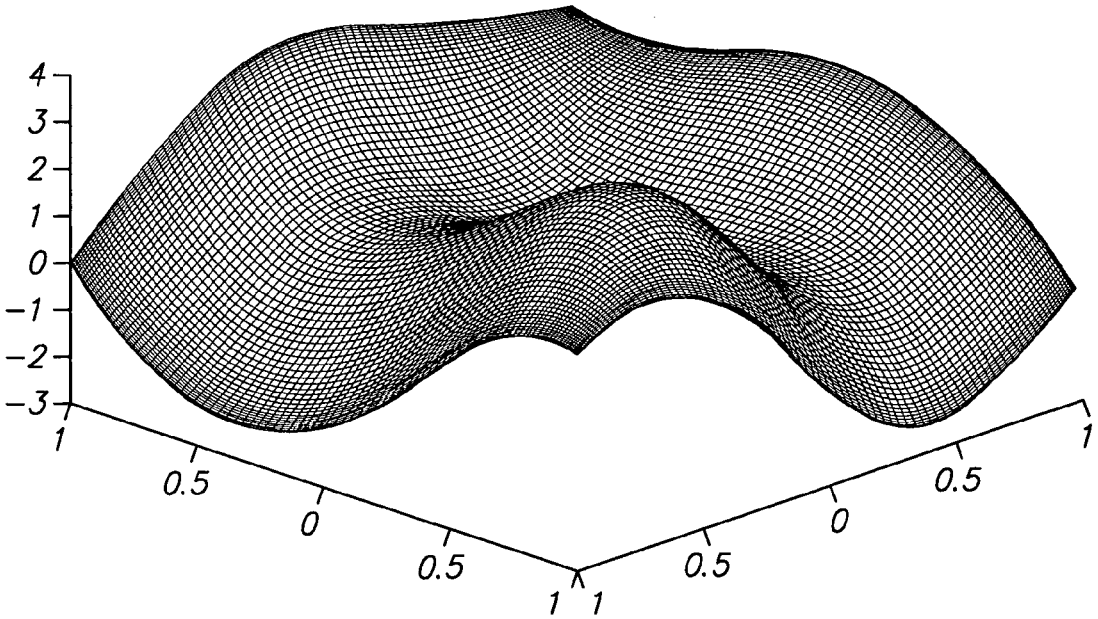

To illustrate the benefits of the invention, FIG. 1(*a*) shows an output according to the above-referenced Standard Method. FIG. 1(*b*) shows an output according to the Tru-Scale Reactance Transformation System. The sparseness of the FIG. 1(*a*) output contrasts with the denseness of the FIG. 1(*b*) output, thereby illustrating the benefit of introducing resonance to reduce EMF collisions.

The inventors have conducted tests, including the following two types. In a first test type, a Tru-Scale Improved Transformer Model (ITM), 1500 Watt design was compared with a Square D Transformer, 1500 Watt standard design, in relation to heat rise. As clearly shown in the results, certified by an independent Ph.D. electrical consultant, there was a substantial reduction in the heat factor because of employment of the harmonic relationships resulting from the use of the Tru-Scale matrix.

TABLE 3

| | Temperature |
|---|---|
| Parameters: 1500 Watt Heat Rise on Square D<br>Start Time: 9:55<br>End Time: 12:27 | |
| Start: | 65.4 |
| 15 mins: | 76.4 |
| 30 mins: | 87.4 |
| 45 mins: | 97.4 |
| 60 mins: | 106.9 |
| 75 mins: | 114.3 |

TABLE 3-continued

| | Temperature |
|---|---|
| 90 mins: | 120.9 |
| 105 mins: | 127.5 |
| 120 mins: | 132.4 |
| 135 mins: | 136.4 |
| 150 mins: | 139.6 |
| 152 mins: | 140 |
| Parameters: 1500 Watt Heat Rise on ITM<br>Start Time: 10:55<br>End Time: 18:33 | |
| Start: | 62.6 |
| 15 mins: | 65.3 |
| 30 mins: | 68.9 |
| 45 mins: | 70.8 |
| 60 mins: | 74.1 |
| 75 mins: | 77 |
| 90 mins: | 79.5 |
| 105 mins: | 79.5 |
| 120 mins: | 82.9 |
| 135 mins: | 85 |
| 150 mins: | 86.6 |
| 165 mins: | 87.6 |
| 180 mins: | 90.1 |
| 195 mins: | 90.4 |
| 210 mins: | 91 |
| 225 mins: | 93.1 |
| 240 mins: | 93.5 |
| 255 mins: | 95.1 |
| 270 mins: | 95.7 |
| 285 mins: | 96.5 |
| 300 mins: | 97.1 |
| 315 mins: | 98.2 |
| 330 mins: | 98.2 |
| 345 mins: | 99.6 |
| 460 mins: | 99.1 |
| . . . | |
| . . . | |
| End 480 mins: | 101.3 |

There was a 53.4 degree temperature differential when ITM was compared with the baseline at the 150 minute mark. After an additional 4.5 hours the ITM was still below 102 degrees.

A second test was performed comparing the Radio Shack baseline and the Harmonic Tru-Scale Consumer Electric Transformer (CET) and the results of the percent reduction of 92.30% and 26.10% clearly showed highly significant results from the present invention.

TABLE 4

| | No Load | | Load |
|---|---|---|---|
| No Load & Load on Radio Shack Baseline | | | |
| Input Volts: E | 122.5 | | 122.5 |
| Input milliamps: I | 28.4 | | 52.5 |
| Output Volts: E | 16.5 | | 12.3 |
| Output Amps I | N/A | | 0.29 |
| Primary Watts: | 3.48 | | 6.43 |
| Sec Watts: | N/A | | 3.57 |
| | | Efficiency | 55.5% |
| No Load & Load on CET | | | |
| Input Volts: E | 122.5 | | 122.5 |
| Input milliamps: I | 2.2 | | 38.8 |
| Output Volts: E | 13.9 | | 12.6 |
| Output Amps I | N/A | | 0.3 |

TABLE 4-continued

| | | | |
|---|---|---|---|
| Primary Watts: | 2.57 | | 4.75 |
| Sec Watts: | N/A | | 3.78 |
| | | Efficiency | 79.6% |

| Comparison to Baseline: | | Percent Reduction |
|---|---|---|
| No Load Current: | 7.70% | 92.30% |
| Load Current: | 73.90% | 26.10% |

The inventors also conducted tests on the heat rise of the Radio Shack baseline and a Tru-Scale CET. The Tru-Scale effects are self evident to anyone familiar with the art.

TABLE 5

| | Temperature |
|---|---|
| Parameters: Heat Rise on Radio Shack<br>Start Time: 14:45<br>End Time: 15:45 | |
| Start: | 64.5 |
| 5 mins: | 76.8 |
| 10 mins: | 86.4 |
| 15 mins: | 92.4 |
| 20 mins: | 96.1 |
| 25 mins: | 100.5 |
| 30 mins: | 102.7 |
| 35 mins: | 104.3 |
| 40 mins: | 104.2 |
| 45 mins: | 105.6 |
| 50 mins: | 108.0 |
| 55 mins: | 109.0 |
| 60 mins: | 108.2 |
| Parameters: Heat Rise on CET<br>Start Time: 16:05<br>End Time: 17:05 | |
| Start: | 64.5 |
| 5 mins: | 66.2 |
| 10 mins: | 66.8 |
| 15 mins: | 67.3 |
| 20 mins: | 67.7 |
| 25 mins: | 68.1 |
| 30 mins: | 68.4 |
| 35 mins: | 68.5 |
| 40 mins: | 68.5 |
| 45 mins: | 68.8 |
| 50 mins: | 69.0 |
| 55 mins: | 69.3 |
| 60 mins: | 69.4 |

Temperature difference compared with baseline: 38.8 degrees in one hour

It should also be noted that the power source is not critical to the invention. The source can be a standard power grid, nuclear-based, wind-based or any other type of power source. What the invention does is to harmonically relate the component parts (electrical-mechanical-magnetic fields) as a single whole to eliminate loss through any type of distortion (heat-flux-impedance). This invention includes any type of inductive devices, movable or stationary, micro or macro, which requires a series of harmonic relationships using the Tru-Scale Reactance Transformation Series as a means of reducing non-harmonic effects.

While the invention has been described in detail above with reference to embodiments, various modifications within the scope and spirit of the invention will be apparent to ordinarily skilled artisans. As a result, the invention should be construed as limited only by the scope of the following claims.

What is claimed is:

1. A transformer comprising:

a. A capacitor having a value selected according to a relationship with flux density, calculated according to a predetermined periodic transformation system;

b. A core having geometric properties selected according to said predetermined periodic transformation system so that dimensions of said core relate harmonically to each other and to the power factor;

c. A primary winding having a first number of turns and first gage selected to have a harmonic relationship to said power factor and to said core according to said predetermined periodic transformation system; and d. At least one secondary winding having a second number of turns and second gage selected to have a harmonic relationship to said power factor, said core, and said primary winding based on said predetermined periodic transformation system.

2. A transformer as claimed in claim 1, further comprising at least one tertiary winding having a third number of turns selected to have a harmonic relationship with said first number of turns.

3. A transformer as claimed in claim 1, wherein said core comprises an alloy comprising a mixture of materials selected from the group consisting of silica and iron; nickel and iron; and cobalt and iron, said mixture being a ratio selected according to said predetermined periodic transformation system.

4. A transformer as claimed in claim 1, wherein said core has magnetic properties selected in accordance with a calculation of desired peak to peak power of said transformer and a calculation of desired peak flux density for said transformer at a calculated power level; and wherein said core has a flux density at ½ of a residual flux density at the calculated power level.

5. A transformer as claimed in claim 1, wherein said first number of turns and said first gage are selected to provide a current density of approximately 161 A/cm$^2$.

6. A transformer as claimed in claim 1, wherein said second number of turns and said second gage are selected to provide a current density of approximately 161 A/cm$^2$.

7. A transformer as claimed in claim 5, wherein said second number of turns and said second gage are selected so as to have a harmonic relationship with said first number of turns and said first gage.

8. A transformer as claimed in claim 1, wherein said predetermined periodic transformation system is Tru-Scale Reactance Transformation System.

9. A transformer as claimed in claim 8, wherein said Tru-Scale Reactance Transformation System comprises the following reactance table for determining a resonance of at least said first winding:

| Capacitive Reactance | Ratio | Interval | Ratio | Inductive Reactance | Interval |
|---|---|---|---|---|---|
| 600 | 25:25 | | 24:24 | 600 | |
| 624 | 26:25 | 24 | 25:24 | 625 | 25 |
| 648 | 27:25 | 24 | 26:24 | 650 | 25 |
| 672 | 28:25 | 24 | 27:24 | 675 | 25 |
| 696 | 29:25 | 24 | 28:24 | 700 | 25 |
| 720 | 30:25 | 24 | 29:24 | 725 | 25 |
| 744 | 31:25 | 24 | 30:24 | 750 | 25 |

-continued

| Capacitive Reactance | Ratio | Interval | Ratio | Inductive Reactance | Interval |
|---|---|---|---|---|---|
| 768 | 32:25 | 24 | 31:24 | 775 | 25 |
| 792 | 33:25 | 24 | 32:24 | 800 | 25 |
| 816 | 34:25 | 24 | 33:24 | 825 | 25 |
| 840 | 35:25 | 24 | 34:24 | 850 | 25 |
| 864 | 36:25 | 24 | 35:24 | 875 | 25 |
| 888 | 37:25 | 24 | 36:24 | 900 | 25 |
| | | | | | 0 |
| 912 | 38:25 | 24 | 36:24 | 900 | 25 |
| 936 | 39:25 | 24 | 37:24 | 925 | 25 |
| 960 | 40:25 | 24 | 38:24 | 950 | 25 |
| 984 | 41:25 | 24 | 39:24 | 975 | 25 |
| 1008 | 42:25 | 24 | 40:24 | 1000 | 25 |
| 1032 | 43:25 | 24 | 41:24 | 1025 | 25 |
| 1056 | 44:25 | 24 | 42:24 | 1050 | 25 |
| 1080 | 45:25 | 24 | 43:24 | 1075 | 25 |
| 1104 | 46:25 | 24 | 44:24 | 1100 | 25 |
| 1128 | 47:25 | 24 | 45:24 | 1125 | 25 |
| 1152 | 48:25 | 24 | 46:24 | 1150 | 25 |
| 1176 | 49:25 | 24 | 47:24 | 1175 | 25 |
| 1200 | 50:25 | 24 | 48:24 | 1200 | 25. |

10. A transformer as claimed in claim 8, wherein said Tru-Scale Reactance Transformation System comprises the following table for determining the winding of said core:

| Capacitive Reactance | Ratio | Interval | Ratio | Inductive Reactance | Interval |
|---|---|---|---|---|---|
| 150 | 25:25 | | 24:24 | 150 | |
| 156 | 26:25 | 6 | 25:24 | 156.25 | 6.25 |
| 162 | 27:25 | 6 | 26:24 | 162.5 | 6.25 |
| 168 | 28:25 | 6 | 27:24 | 168.75 | 6.25 |
| 174 | 29:25 | 6 | 28:24 | 175 | 6.25 |
| 180 | 30:25 | 6 | 29:24 | 181.25 | 6.25 |
| 186 | 31:25 | 6 | 30:24 | 187.5 | 6.25 |
| 192 | 32:25 | 6 | 31:24 | 193.75 | 6.25 |
| 198 | 33:25 | 6 | 32:24 | 200 | 6.25 |
| 204 | 34:25 | 6 | 33:24 | 206.25 | 6.25 |
| 210 | 35:25 | 6 | 34:24 | 212.5 | 6.25 |
| 216 | 36:25 | 6 | 35:24 | 218.75 | 6.25 |
| 222 | 37:25 | 6 | 36:24 | 225 | 6.25 |
| | | | | | 0 |
| 228 | 38:25 | 6 | 36:24 | 225 | 6.25 |
| 234 | 39:25 | 6 | 37:24 | 231.25 | 6.25 |
| 240 | 40:25 | 6 | 38:24 | 237.5 | 6.25 |
| 246 | 41:25 | 6 | 39:24 | 243.75 | 6.25 |
| 252 | 42:25 | 6 | 40:24 | 250 | 6.25 |
| 258 | 43:25 | 6 | 41:24 | 256.25 | 6.25 |
| 264 | 44:25 | 6 | 42:24 | 262.5 | 6.25 |
| 270 | 45:25 | 6 | 43:24 | 268.75 | 6.25 |
| 276 | 46:25 | 6 | 44:24 | 275 | 6.25 |
| 282 | 47:25 | 6 | 45:24 | 281.5 | 6.25 |
| 288 | 48:25 | 6 | 46:24 | 287.5 | 6.25 |
| 294 | 49:25 | 6 | 47:24 | 293.75 | 6.25 |
| 300 | 50:25 | 6 | 48:24 | 300 | 6.25. |

* * * * *